United States Patent [19]

McNinch

[11] 4,168,409

[45] Sep. 18, 1979

[54] SECURITY HINGE WITH SEALED SWITCH AND OPERATOR CONCEALED THEREIN

[75] Inventor: Delmar McNinch, Rock Falls, Ill.

[73] Assignee: Lawrence Brothers, Inc., Sterling, Ill.

[21] Appl. No.: 933,280

[22] Filed: Aug. 14, 1978

[51] Int. Cl.[2] ..... H01H 3/16; H01H 9/04

[52] U.S. Cl. ..... 200/61.7; 200/153 T; 200/302; 339/4

[58] Field of Search ..... 200/61.7, 153 T, 302; 339/4

[56] References Cited

U.S. PATENT DOCUMENTS

| | | | |
|---|---|---|---|
| 3,715,537 | 2/1973 | Peterson | 200/61.7 |
| 3,729,603 | 4/1973 | Foltz | 200/61.7 |
| 3,803,375 | 4/1974 | Foltz | 200/61.7 |
| 3,838,234 | 9/1974 | Peterson | 200/61.7 |
| 3,840,715 | 10/1974 | Gwozdz | 200/61.7 |
| 4,049,934 | 9/1977 | Newlon | 200/61.7 |
| 4,066,857 | 1/1978 | Suska | 200/61.7 |

FOREIGN PATENT DOCUMENTS

| | | | |
|---|---|---|---|
| 1279381 | 6/1972 | United Kingdom | 200/61.7 |
| 1333034 | 10/1973 | United Kingdom | 200/61.7 |

*Primary Examiner*—James R. Scott

*Attorney, Agent, or Firm*—Trexler, Wolters, Bushnell & Fosse, Ltd.

[57] ABSTRACT

A security hinge construction includes a pair of hinge leaves each having at least one knuckle. An electric switch is fixedly mounted within one of the knuckles and a switch operating means is disposed within the other knuckle. The switch or electrical component is sealed within its associated knuckle and an O-ring seal is disposed between the two knuckles to effectively seal the switch or electrical component from the intrusion of moisture or the like which negates the monitoring effect of the assembly if such sealing means were not present.

22 Claims, 7 Drawing Figures

SECURITY HINGE WITH SEALED SWITCH AND OPERATOR CONCEALED THEREIN

BACKGROUND OF THE INVENTION

The present invention relates generally to hinge structures, and more particularly to a security hinge construction wherein there is employed a concealed electrical component such as a switch, which can be wired into an external electrical circuit to provide an indication at a monitoring panel or the like, as to the relative position of the door, viz., whether it is closed, fully opened, or partially open.

In many situations, such as building security, fire safety, environmental control and the like it is desirable to monitor doors in a building or structure so as to provide some indication as to their condition. For example, it may be desired to know whether the door is fully closed, fully open, or even ajar somewhat.

Hinge constructions have been employed wherein a switch or the like was mounted directly to the hinge leaves, as for example in U.S. Pat. Nos. 3,729,603; 3,715,537; 3,803,375; 4,066,857; 4,049,934 and British Pat. No. 1,279,381. These prior art arrangements, though useful for some purposes, fail to meet the requirements of certain security situations, as in certain of the prior art designs the switches, wires and switch actuating members were generally exposed at some point during the operation of the associated door. It will be appreciated that one desirable characteristic of a security type hinge is concealment of the switch and associated elements, so as to give no external indication of the nature of the security hinge, but on the contrary, provide a conventional looking hinge exterior appearance. In others, while the switch is concealed, it is not effectively sealed against the entry of moisture.

As a further matter, it is also desirable, as briefly indicated above, to provide such a hinge actuated switch arrangement which is capable of providing an indication for several different conditions of the associated door. Accordingly, a desirable feature of such a security hinge is its adaptability to a desired use, in providing a suitable indication only at the desired point of door movement in each particular application.

Moreover, with the introduction of electrical components such as a switch into a pivotally movable hinged structure, it is important to assure that wires, leads, or the like exiting the structure will not be impinged upon or otherwise disturbed during operation of the hinge, to insure the integrety of the electrical circuit connections required for proper operation of the device. Also in connection with insuring reliable electrical operation of the device, it is desirable to provide such a switch arrangement which is adapted for effectively sealing the electrical components against intrusion by moisture or the like. This latter consideration is also important in obtaining approval of rating agencies such as Underwriters Laboratories.

Accordingly it is a general object of this invention to provide a new and improved security hinge construction adapted to provide an indication as to the opening and closing or relative position therebetween of an associated door member.

A more specific object of this invention is to provide a hinge construction with an improved operating arrangement, and which arrangement is selectively adjustable for use in a variety of applications, wherein such indication is to be given for different relative positions of an associated door.

A further object of this invention is to provide a hinge construction of the type described wherein the electrical components are sealed against intrusion by moisture or the like, without regard for the relative orientation or mounting position of the hinge structure upon its door.

Yet another object of this invention is to provide a hinge construction of the type described which is further adapted to protect the electrical components and connections to external devices against mechanical wear, abrasion, or the like, so as to provide a relatively long service life without regard to the frequency of operation of the associated door.

Briefly, and in accordance with the foregoing, a hinge structure is provided which includes, first and second pivotally connected hinge leaves, each leaf including at least one knuckle disposed adjacent to and pivotally movable relative to the knuckle on the other leaf, an electrical circuit component including actuator means carried by one of said leaves, and capable of producing a change in an output condition thereof, operating means carried by the other of said hinge leaves for operating said actuator means in response to relative movement between said hinge leaves to produce said change in condition of said electrical component, and sealing means for effectively sealing the knuckle interface thus protecting said electrical circuit component against intrusion of moisture or the like, substantially without regard to the relative orientation or mounting position of said hinge construction. Further, there is provided an improved operating means employing an offset piston arranged for operating said plunger and increasing the sensitivity of said hinge to relative movement.

Other objects, features and advantages of this invention will become more readily apparent upon consideration of the following detailed description together with the accompanying drawings.

DETAILED DESCRIPTION OF THE ILLUSTRATED EMBODIMENT

While the present invention will be illustrated and described with reference to a switch, it is envisioned that other electrical components could be employed, for example a variable resistor. Moreover, any suitable component capable of producing a change in an output condition in response to detection of a change in position may be utilized without departing from the spirit and scope of the present invention.

Figure 1:
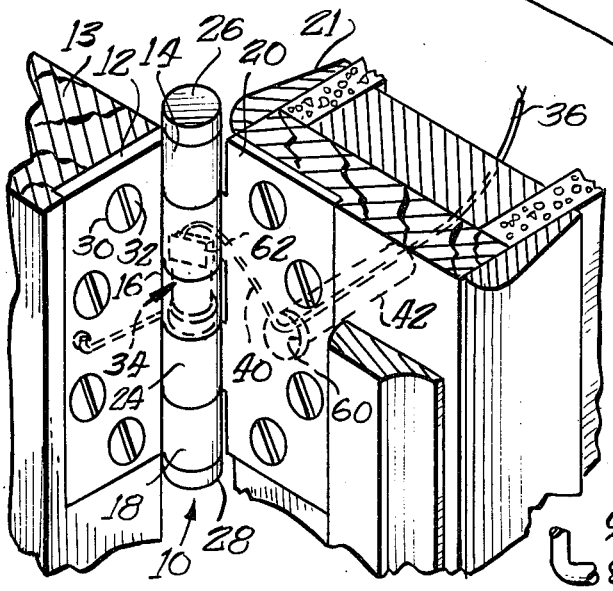
FIG. 1 is a perspective view illustrating a security hinge in accordance with the present invention mounted to a door and door frame assembly, illustrated in partial perspective, with the door in a partially open condition.

Attention is directed initially to FIG. 1, wherein a hinge construction, designated generally 10, according to the invention, is shown in an assembled condition. Generally speaking, the hinge 10 is of a standard design so as to present a conventional exterior appearance, thereby concealing the presence of internal electrical monitoring components. These components which are concealed from view in the assembled hinge structure 10, are illustrated in dotted or phantom outline in FIG. 1.

In accordance with conventional practice, the hinge 10 includes a first leaf 12 attached to a door 13 and having hinge knuckles 14, 16 and 18. A mating leaf 20 is affixed to a door frame or jamb 21 and includes hinged knuckles 22 and 24 pivotally engaged between the hinge knuckles 14, 16 and 18 in conventional fashion. The leaves and their respective knuckles are maintained in an assembled condition by hinge pins or pintles 26 and 28. The leaves 12 and 20 are affixed to the respective door 13 and door frame 21 by conventional means such as a series of apertures 30 in which mounting screws 32 are received.

The electrical monitoring apparatus or components, designated generally 34, reside entirely within the adjacent hinge knuckles 16 and 22. Suitable lead wires designated generally 36 are joined with the electrical components 34 and are fed outwardly of the knuckle 22. These lead wires 36 pass through a suitable channel or tunnel 40 formed in the leaf 20, and exit the leaf 20 to an adjacent passageway 42 in the door jamb for connection to suitable external indicator circuits (not shown). It will be noted that the passageway 42 and tunnel 40 receiving the lead wire 36 are also concealed from view when the hinge structure 10 is in its assembled condition and mounted upon the door frame 21.

Figure 2:
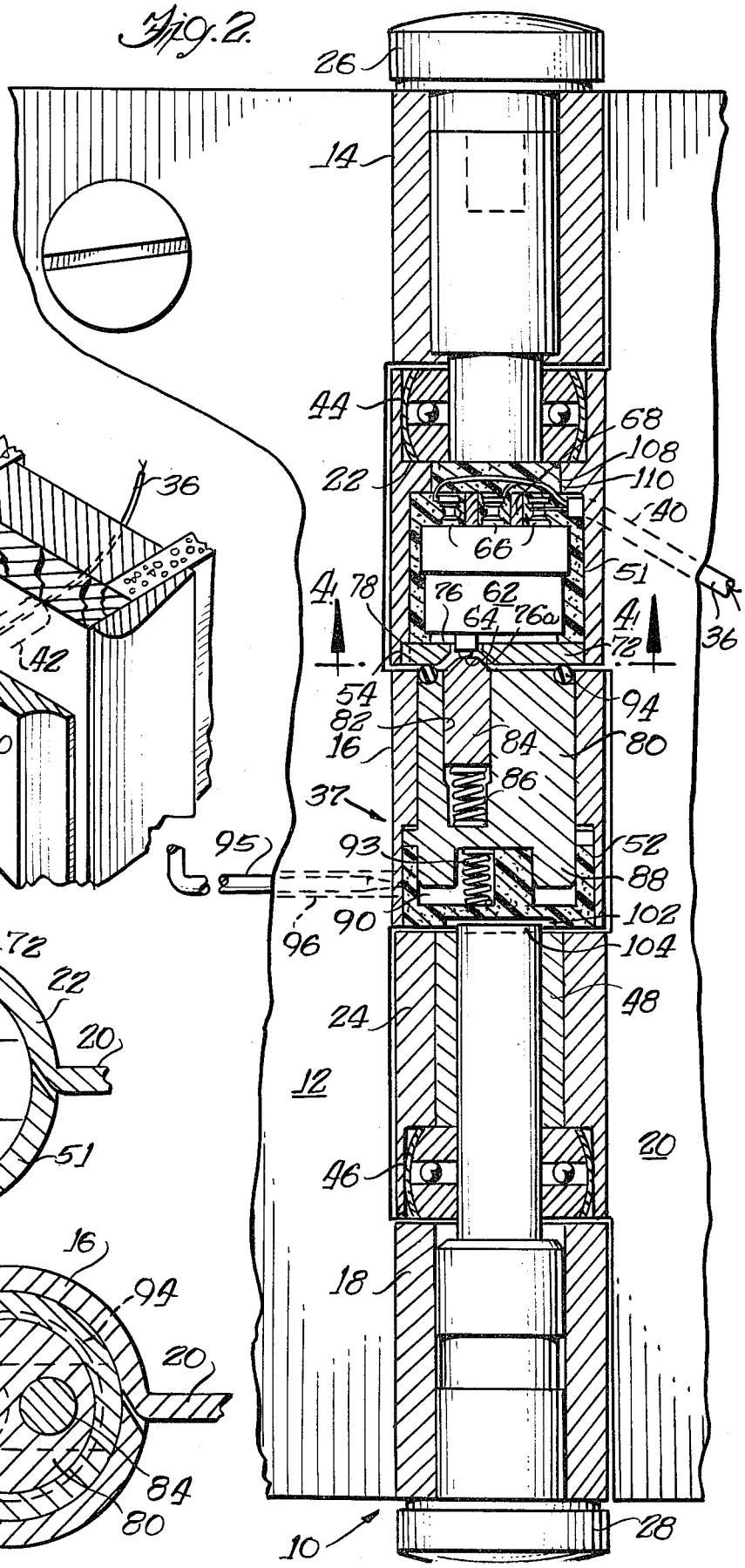
FIG. 2 is a sectional view of the hinge barrel of the hinge of FIG. 1, the hinge leaves having been shown separated, for purposes of illustration, as would occur with the door fully open.
Figure 4:
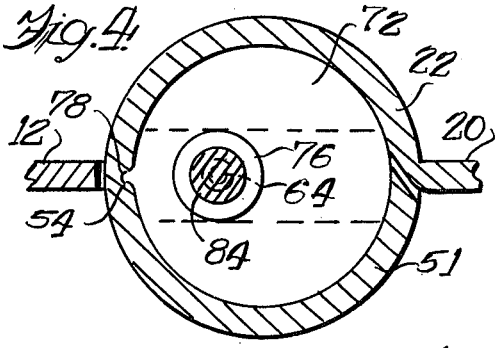
FIG. 4 is a sectional view taken generally along the line 4—4 of FIG. 2.
Figure 5:
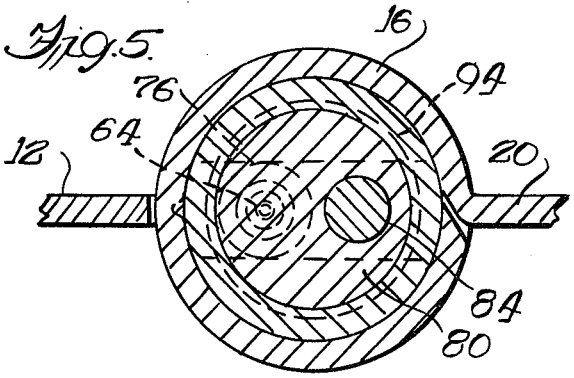
FIG. 5 is a sectional view similar to FIG. 4, taken generally along the line 5—5 of FIG. 3.
Figure 3:
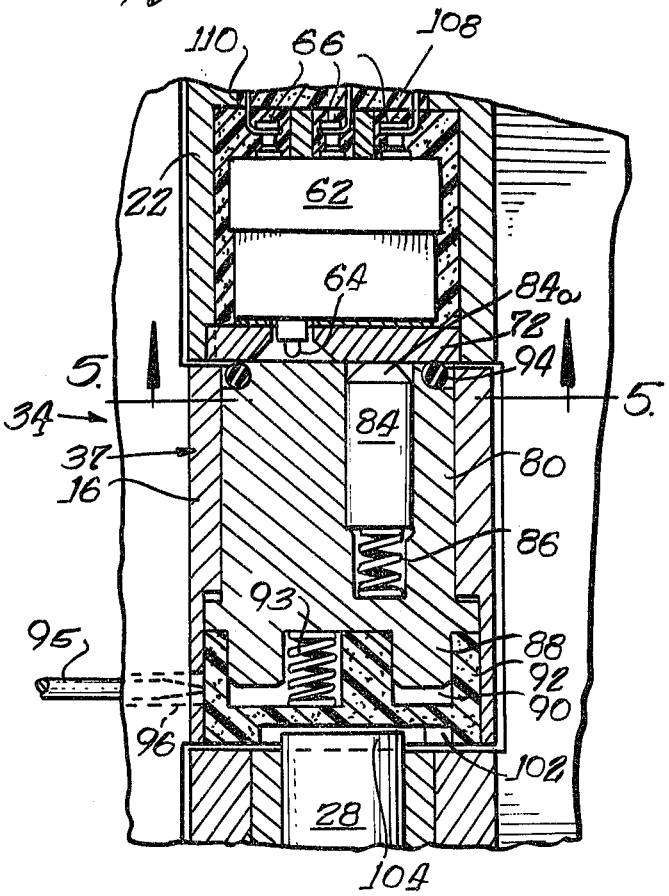
FIG. 3 is a sectional view of a portion of the hinge of FIG. 2 and similar thereto, but illustrating the condition of the components when the door has moved approximately 180° from the position as represented by FIG. 2.

Before considering FIGS. 2–5 specifically, it should be noted that FIGS. 2 and 4 illustrate the condition of the components 34 when the leaves 12 and 20 are in a given orientation. FIGS. 3 and 5 illustrate the condition of these components 34 subsequent to relative movement of the leaves 12 and 20 through approximately 180°. As will be explained, the assembly of components 34 includes adjustment means, so that the condition of the components in either FIG. 2 or FIG. 3 can be attained with the leaves fully opened, closed, or any intermediate position, depending upon the use for the security hinge, the circuit component, or what relative position it is desired to monitor. For purposes of clarity and illustration, it was deemed advisable to illustrate the leaves 12 and 20 fully open in both FIGS. 2 and 3, it being understood that in practice, if the orientation of the components 34 in FIG. 2 represent the door closed condition, the leaves 12 and 20 would also be closed. The discussion which follows will be presented assuming that the condition of FIG. 2 is attained upon the door being closed, with FIG. 3 illustrating condition upon approximately 180° of opening movement.

Referring now to FIGS. 2 and 4, the monitoring components 34 are illustrated in additional detail, in their assembled condition in the knuckles 16 and 22 of the hinge 10, it being recalled that the door 13 is assumed to be in its closed position. As mentioned above, the hinge 10 is generally a standard or commercial type hinge modified to accommodate the novel monitoring assembly or components 34. Accordingly, the aligned hinge knuckles and their corresponding leaves 12 and 20 are maintained in an assembled condition by hinge pins or pintles 26 and 28. Specifically, an upper hinge pin 26 passes through the knuckle 14 and a portion of the knuckle 22, while the lower hinge pin 28 passes through the knuckles 18 and 24. In the illustrated embodiment, ball bearing assemblies 44 and 46 are disposed in recesses formed in the knuckles 22 and 24 of the leaf 20 to facilitate the smooth pivotal action of the hinge 10. Also, a bearing sleeve 48 is employed surrounding the hinge pin 28. These features are known in the art and serve to provide a smooth working and dependable hinge.

Figure 6:
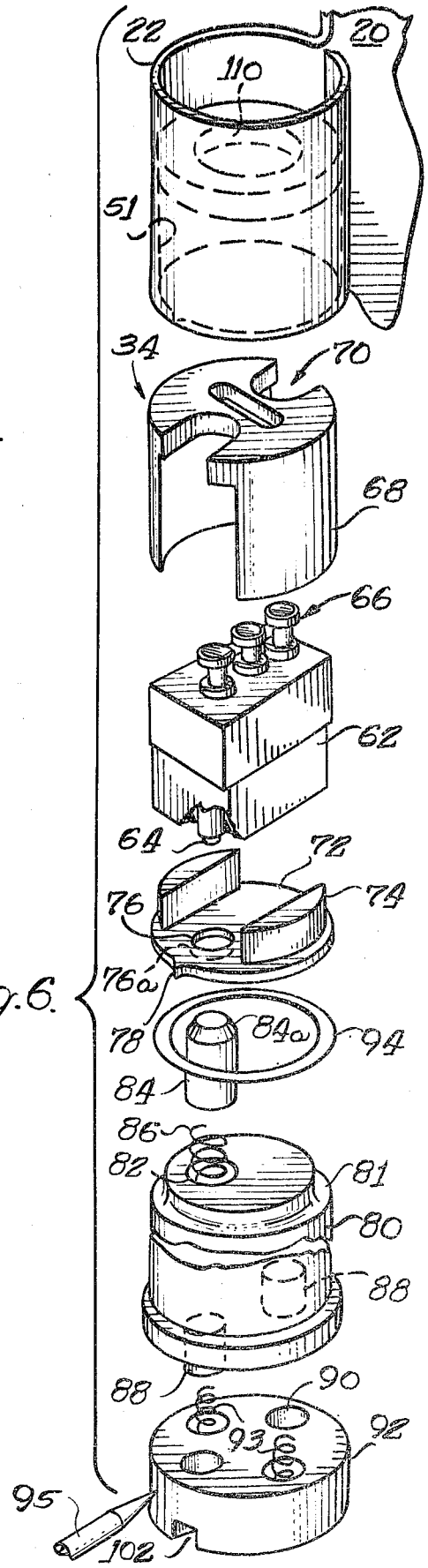
FIG. 6 is an exploded perspective view of the electrical circuit component and related elements in accordance with features of this invention.

In the discussion to follow, attention will be directed primarily to FIGS. 2–5; however, since FIG. 6 illustrated the various components of assembly 34 in exploded perspective, reference thereto will facilitate an understanding of the general construction of the various components. In accordance with the present invention, the knuckles 16 and 22 have been modified to accommodate the monitoring assembly or components 34. In this regard, the knuckle 22 is provided with an enlarged bore portion 51. Similarly, the knuckle 16 has been provided with an enlarged bore portion 52. Also, a small notch or radially outwardly extending opening 54 has been provided in the knuckle 22 for purposes of positioning components of the monitoring assembly 34 as will be more fully described below.

Broadly speaking, the monitoring assembly 34 includes some form of electrical component such as a switch, which is responsive to the mechanical motion of the associated door 13 so as to provide a change in its output characteristic or state for activating a suitable electrical indicator or alarm circuit (not shown) connected therewith by means of the wires or leads 36. In addition to an electrical circuit component, the monitoring assembly includes operating means 37 for the component for actuating the component to produce the above-mentioned response or change, incident to relative movement of the hinge leaves 12 and 20 as would occur upon the opening or closing of the door 13. Moreover, in accordance with a feature of this invention, the electrical component or switch is effectively sealed against the intrusion of moisture or the like, from either side of the mounting knuckle substantially without regard to the orientation of the hinge structure 10, viz., whether mounted as per the drawings, or inverted.

As mentioned above, the leaf 20 is provided with an internal channel or passageway 40 for accommodating the wires or leads 36, which passageway extends generally parallel to the surface of the leaf 20 and opens into the knuckle bore portion 51. The passageway 40 intersects a transverse aperture or bore 60 formed in the rear surface of the leaf 20, which bore provides an outlet through the rear face of the leaf 20 which may be aligned with the passageway 42 in the door frame for feeding the leads or wires 36 from the hinge 10 to suitable external indicators or circuits.

Attention is now also invited to FIG. 6 which illustrates the components of the monitoring assembly 34 in exploded perspective view, together with the hinge knuckle 22. The monitoring assembly 34 includes a switch 62 which has an actuating plunger 64 and a series of terminals 66. This switch 62 may be of a conventional construction, including both normally open and normally closed terminals 66, so as to provide a suitable indication comprising either an open circuit or a closed circuit condition, as desired in a particular application, to external indicator or alarm circuits. The switch plunger 64 is offset with respect to the body of the switch 62 and the axis of the knuckle bore 51. The switch 62 is mounted in a housing or mounting element 68 of insulating material which is suitably configured including channels and openings designated generally 70 to accommodate the switch and terminals 66 as best seen in FIG. 6. Also a switch carrier or base plate 72 is provided for holding the bottom portion of the switch 62 in position with respect to the bore 51 of the knuckle 22. It will be seen that the switch carrier 72 is provided with a pair of arcuate upstanding wall segments 74. Upon assembly the switch 62 is disposed within mounting housing 68 and the plate 72 is positioned, with wall segments 74 on opposite sides of the switch, said segments 74 being received within the housing 68, with the respective arcuate surface portions of segments 74 and the inner wall of the housing 68 frictionally engaged so as to effectively encase or house the switch 62 therein. The switch mounting plate 72 also includes a suitable aperture 76 therethrough set somewhat off center for receiving the offset switch plunger 64, so as to expose the plunger axially outwardly of the housing for actuation by the operating or actuating assembly to be described below.

In accordance with a feature of the invention, the switch plunger 64 is disposed somewhat off center and maintained at a predetermined radial position with respect to the central axis of the hinge knuckle 22. As best viewed in FIGS. 4 and 5, switch mounting plate 72 also includes a tab or radially outwardly extending tooth 78 which cooperates with the aforementioned positioning slot or notch 54 of the bore 51 so as to maintain the radial position of the switch 62 and specifically the plunger 64 with respect to the knuckle bore 51.

The operating means 37 converts the relative rotation between the hinge knuckles upon opening or closing of the door into a suitable movement for operation of the switch plunger 64. In this regard, the illustrated form of operating means 37 includes a housing 80, having a cylindrical bore 82 formed therein which receives a piston member 84 and a compression spring 86. As can be seen in FIG. 2, the bore 82 and correspondingly piston 84 are offset with respect to the axis of knuckle 16. When the piston 84 is aligned with the aperture 76, the piston moves upwardly under the force of spring 86 to engage, and depress plunger 64. The lower end portion of the housing 80 is provided with a pair of axially extending posts or positioning members 88 which are, in the assembled condition, received within complementary apertures 90 formed in a generally cylindrical or disc-shaped positioning member 92. The positioning member 92 includes a pair of compression spring members 93 which engage the lower portion of the housing 80 and urge it upwardly toward the knuckle 22 carrying the switch 62 and plate 72.

In accordance with a feature of the invention, a flexible annular sealing member, preferably in the form of an O-ring 94 is carried by the upper end face of the housing 80 in a suitable groove 81 formed therein. As can be seen in FIG. 2, the spring means 93 bias the housing 80 upwardly to cause the O-ring 94 to engage the planer end face of plate 72. Further, it should be noted that said O-ring 94 in this condition, completely surrounds the aperture 76 as well as piston 84. Accordingly, O-ring 94 effectively seals the interface between knuckles 16 and 22 protecting the switch 62 against the intrusion of moisture or the like from the direction of the operating means 37, when the assembly 34 is in its assembled condition, as viewed in FIGS. 2 and 4.

Figure 7:
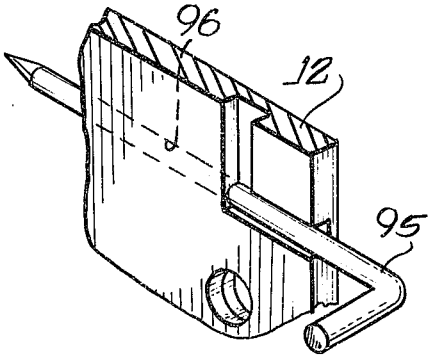
FIG. 7 is a partial, perspective view illustrating a portion of one form of adjustment means in accordance with a feature of this invention.

Attention is now directed back to the positioning element or member 92. In the illustrated embodiment, the member 92 is formed of a relatively soft elastomeric material capable of being penetrated by a sharp object such as a pin or the like. Accordingly, a pin 95 is carried by the hinge leaf 12 and is mounted within a passageway 96 formed therein, which passageway 96 opens into the hinge knuckle 16, so as to enable the pin 95 to engage the positioning element 92 as shown. Accordingly, the pin 95, as best viewed in FIG. 7 is inserted into the channel 96 so as to penetrate the side surface of the positioning element 92, and fix the relative rotatable position thereof with respect to the hinge knuckle 16. It can be appreciated that since the housing 80 is keyed to the element 92 by way of disposition of pins 88 in sockets 90, the relative position of element 92 determines the corresponding relative position of housing 80 and most importantly, piston 84. In the illustrated design, a slot 102 is formed in the axially outer or lower surface of the driver element 92, as viewed, and a suitable tool such as a screwdriver may be inserted in said slot to adjust the relative position of element 92 and correspondingly piston 84. Once the desired position is attained, pin 95 is engaged to maintain this orientation. In the illustrated embodiment, the hinge pin or pintle 28 is provided with a suitable driver head portion 104 for this purpose. It should be noted that an adjustment feature such as described above is illustrated in prior patent to applicant, U.S. Pat. No. 4,049,934, mentioned above.

With regard to operation and installation of the hinge 10, initially the positioning element 92 is oriented to align the piston 84 for engagement with and depression of the switch plunger 64, the door is in a position desired to be monitored, for example, fully closed as per this discussion. Thus, a first output state or condition is established for the switch or circuit component 62 which corresponds to the associate door 13 being in its fully closed position, and results from the switch plunger 64 being depressed. It will be seen that the piston member 84 is provided with a sloped or rounded top surface **84*a* which is received within a complementary surface portion 76*a* of the aperture 76 in the facing side of the switch plate 72. Accordingly, upon opening of the door 13 the resulting rotation of the knuckle 16 relative to the knuckle 22 that occurs will produce rotation of the housing 80 and consequently rotation of the piston 84 out of alignment with the aperture 76 and switch plunger 64 as best seen in FIG. 5. This relative rotation will effect retraction of the piston 84 within its cylinder 82 against the compression spring member 86, facilitated by the aforementioned sloped or rounded surfaces 84*a* and 76*a*. Accordingly, this movement of the door from its closed position, will result in the components of the assembly 34 assuming the condition as illustrated in FIG. 5, which corresponds generally to 180° of door opening movement. As can be seen in FIG. 3, the piston 84 no longer is aligned with aperture 76, nor is it in engagement with the switch plunger 64, but is engaged with the planar end surface of the switch carrier plate 72 facing the knuckle 16. Accordingly, the switch plunger 64 which is received within aperture 76 will return under the action of internal spring means (not shown) to its "normal" position, producing a change or second output state for the switch terminals 66. To summarize briefly, the first described output state, as illustrated in FIGS. 2 and 4, for the switch 62, corresponds to the door 13 being in its fully closed position, while the second output state of FIGS. 3 and 5 for the switch 62** corresponds to the door being in other than its fully closed position, i.e. partially or fully opened.

It should be noted, that the operating arrangement 37 of the present invention coupled with the offset mounting of the switch plunger 64 is believed to be a significant improvement over the prior arrangements. In this regard, only relatively small displacement of the leaves from the initial or monitored position will result in operation of the switch or circuit component from the first state, FIG. 2 to the second state, represented by FIG. 3. The referenced prior art designs employed co-axial mounting which resulted in significant lag time between initial movement and a change in the condition of the circuit component.

Alternative modes of operation can be attained from different alignments of the position element 92, via the slot 102 and the retaining pin 95. Such alternative alignments will effect different sets of output conditions, or "rules" for the operation of the switch 62. For example, the position member 92 may be rotated and fixed in a position such that the above-described output conditions and the point of change therebetween of the switch 62 occur at any desired angular position of the door 13 with respect to the door frame 21. Thus, a suitable indication of movement of the door to any angular position is possible, with the present invention, from the fully closed position of the door 13 to its fully open position. It will be appreciated in this regard that the fixing of the radial position of the switch 62 by means of the cooperating tab 78 and notch 54 described above assures that the relative radial position of the element 92 and piston 84 will alone be determinative of the point at which the switch plunger 64 is actuated, or the switch 62 output state changed, in a particular application.

Further in accordance with an important feature of this invention, it will be seen that the switch 62 is effectively sealed at its top or upper end, that is on the end of knuckle 22 opposite the interface with knuckle 16, which it will be recalled is sealed by O-ring 94. Specifically, a suitable insulating material such as a potting compound 108 of any one of several well known compositions is introduced into the bore of the knuckle 22 and in its liquid state will flow downwardly through notches 70 to fill the interior of the element 68 and surround the switch 62, terminals 66 and leads 36. The potting material 108 then gels or solidifies in conventional fashion, substantially filling a bore portion 110 of the knuckle 22 axially outwardly, or above, the switch 62. Accordingly, this end of the switch 62 is also effectively sealed against the intrusion of moisture or the like from above. Moreover, this potting material 108 also effectively protects the terminals 66 and their interconnections with the leads 36 from mechanical vibrations, abrasion, or the like which might otherwise cause damage during the operation of the associated hinge structure 10. Thus, the provision of the sealing layer of potting material 108, together with the above-described action of the sealing O-ring 94, effectively seals the switch and electrical connections within the hinge knuckle 22, against the intrusion of moisture or the like, substantially without regard to the relative orientation of the hinge 10.

While a preferred form of the present invention has been illustrated and described herein, it is not intended that the invention be limited thereto. On the contrary, it is expected and contemplated that various changes, modifications and alternatives may be made and will become apparent to those skilled in the art, once apprised of the present invention, and are therefore intended that the spirit and scope of this invention be determined by the claims appended hereto.

The invention is claimed as follows:

1. A hinge construction comprising: first and second pivotally connected hinge leaves, each leaf including at least one hinge knuckle which is disposed closely adjacent to and movable relative to the knuckle on the other of said leaves, a circuit component assembly carried by one of said knuckles, and including a circuit component and actuator means capable of producing a change in condition of said component upon movement thereof, operating means carried by the other of said knuckles, such that upon movement of said hinge leaves relative to each other, said operating means will be moved relative to said means to operate said actuator means and thereby produce said change in condition of said electrical circuit component, which change in condition may be used as an indication in a change in the relative orientation of said hinge leaves, and sealing means for effecting sealing of the interface between said knuckles thereby protecting said circuit component against the intrusion of moisture or the like.

2. A hinge construction according to claim 1 wherein said circuit component assembly includes a plate member carried by said one knuckle proximate the interface of said knuckles, and including a substantially planar surface facing said other knuckle, said operating means including an annular sealing member, and biasing means urging said sealing member into sealed contact with said planar surface of said plate member to seal said interface against the entry of moisture.

3. A hinge construction according to claim 2, wherein said operating means includes a housing member movable axially in the bore of said other knuckle, said sealing member being carried by said housing member, and spring means biasing said housing member toward said one knuckle to force said sealing member into engagement with said planar surface of the plate member.

4. A hinge construction according to claim 3, wherein said housing member includes an offset, axially extending bore, a piston member carried in said bore, and biasing means urging said piston member axially toward said circuit component assembly for engaging said actuator means.

5. A hinge construction according to claim 4, wherein said plate member includes an offset aperture through which said actuator means extends for engagement by said operating means, such that when said leaves are in said first predetermined orientation said piston will be aligned with said aperture in said plate to engage said actuator means to produce a first condition for said circuit component, with relative movement of said leaves causing said piston to move out of alignment with said actuator means, permitting said actuator means to move thereby producing a second condition for said circuit component.

6. A hinge construction according to claim 4, wherein said operating means includes means for fixedly adjusting the relative rotative position of said housing with respect to said other knuckle, such that the relative position of the leaves which produces engagement of said piston with said actuator means can be controlled.

7. A hinge construction according to claim 1, wherein said sealing means comprises an axially movable member disposed in the bore of one of said knuckles, a sealing member carried by an end face of said housing member forming the other of said knuckles, biasing means urging said housing member axially to cause said sealing member to be compressively engaged thereby sealing the interface between said knuckles against the entry of moisture.

8. A hinge construction according to claim 7, wherein said axially movable member is carried by said knuckle carrying said operating means, and said axially movable member forms a component of said operating means.

9. A hinge construction according to claim 7, wherein said sealing member is an O-ring.

10. A hinge construction according to claim 1, wherein actuator means comprises a movable plunger on said circuit component for effecting said change of condition, said movable plunger being oriented substantially for movement in an axial direction with respect to said one hinge knuckle and offset from the central axis of said one hinge knuckle, and said operating means includes piston means resiliently biased into engagement with said plunger means and housing means carrying and mounted for rotation in unison with said other knuckle for effecting disengagement of said piston means from said plunger means in response to relative rotation of said hinge knuckles.

11. A hinge construction according to claim 10 wherein said electrical circuit component comprises a switch having both normally open and normally closed terminal means and further including lead wires joined with said terminal means and extending exteriorly of said hinge.

12. A hinge construction as defined in claim 10, wherein said sealing means includes a plate member carried by said one knuckle at the interface with said other knuckle, said plate member including a substantially flat surface facing said operating means of said other knuckle, a flexible sealing member carried by said housing means for engagement with said flat surface, and means associated with housing means resiliently biasing said sealing member toward said surface thereby compressing said O-ring therebetween for effecting said sealing of said knuckle interface.

13. A hinge construction as defined in claim 1 further including additional sealing means in the form of a layer of insulating potting material in said one knuckle, covering said circuit component and effectively sealing said component against intrusion of moisture from a direction axially outwardly of said knuckle.

14. A hinge construction comprising first and second hinge leaves, each leaf including at least one hinge knuckle which knuckles are adjacently disposed and relatively movable, a circuit component assembly, including a switch or the like, carried within one of said knuckles and including an axially offset plunger for the operation thereof, operating means carried within the other of said knuckles and including means engageable with said plunger for the operation thereof, said operating means comprising an axially offset piston member carried by said housing, and biasing means urging said piston toward said one knuckle for engagement with said plunger to operate said switch, when the relative orientation of said leaves produces alignment of said piston with said plunger.

15. A hinge construction according to claim 14 further including sealing means for sealing the interface of said knuckles, to protect said switch against the entry of moisture along said knuckle interface.

16. A hinge construction according to claim 15, further including additional sealing means for said circuit component, for protecting said component against the entry of moisture from the end of said knuckle opposite the interface with said operating means carrying knuckle.

17. A hinge construction according to claim 16 wherein said additional sealing means comprises an insulating potting material, substantially filling said knuckle bore and overlying said switch component.

18. A hinge construction according to claim 15, wherein said sealing means for sealing said knuckle interface, includes an annular seal member resiliently urged into sealing engagement about said interface.

19. A hinge construction according to claim 14, wherein said operating means further includes a housing member carried within said other knuckle bore, said axially offset piston member being carried by said housing member, and means for adjustably fixing the rotative position of said housing in said knuckle bore, correspondingly, to adjust the point in the relative movement of said hinge leaves which will produce alignment of said piston and said plunger.

20. A hinge construction according to claim 19, further including an annular sealing member carried by said housing member and means biasing said housing member axially toward said one knuckle, to force said sealing member into sealing contact thereby to seal the interface of said knuckles and protect said circuit component against the entry of moisture.

21. A hinge construction according to claim 14 further including a housing member carried within the bore of said other knuckle, with said axially offset piston means being carried by said housing member, an annular seal member carried by the end face of said housing member in surrounding relation to said piston means, biasing means urging said housing member axially to force said seal into sealed engagement thereby to seal the interface between said knuckles against the entry of moisture.

22. A hinge according to claim 21 wherein said circuit component assembly includes an end plate including a substantially planar surface facing said other knuckle, and aperture means in which said axially offset plunger is recessed, said aperture means and said piston means including cooperating tapered surfaces which permit said piston means to enter said opening when aligned therewith to engage said plunger, said tapered surface engaging upon subsequent relative movement of said leaves to facilitate withdrawal of said piston means from said aperture, with said piston means engaging said planar surface.

* * * * *